US006916134B2

(12) United States Patent
Wong

(10) Patent No.: US 6,916,134 B2
(45) Date of Patent: Jul. 12, 2005

(54) SAFETY RING BINDER HAVING SLIDING ACTUATORS

(75) Inventor: Yiu Wing Wong, Ma On Shan (HK)

(73) Assignee: Hong Kong Stationery Manufacturing Co., Ltd., Kowloon (HK)

( * ) Notice: Subject to any disclaimer, the term of this patent is extended or adjusted under 35 U.S.C. 154(b) by 68 days.

(21) Appl. No.: 10/442,962

(22) Filed: May 22, 2003

(65) Prior Publication Data

US 2004/0234328 A1 Nov. 25, 2004

(51) Int. Cl.[7] ..... B42F 3/04

(52) U.S. Cl. ..... 402/26; 402/20; 402/21; 402/28; 402/31; 402/37; 402/38; 402/39; 402/41; 402/45

(58) Field of Search ..... 402/20, 21, 26, 402/27, 28, 31, 37, 38, 39, 41, 4

(56) References Cited

U.S. PATENT DOCUMENTS

| | | | | |
|---|---|---|---|---|
| 2,013,416 A | | 9/1935 | McClure | |
| 2,439,675 A | | 4/1948 | Segal | |
| 2,612,169 A | | 9/1952 | Segal | |
| 3,077,888 A | | 2/1963 | Thieme | |
| 4,566,817 A | | 1/1986 | Barrett, Jr. | |
| 4,571,108 A | | 2/1986 | Vogl | |
| 4,919,557 A | | 4/1990 | Podosek | |
| D389,182 S | | 1/1998 | Law | |
| 5,788,390 A | | 8/1998 | Law | |
| 5,788,391 A | | 8/1998 | Cheung | |
| 5,788,392 A | | 8/1998 | Cheung | |
| 5,807,006 A | | 9/1998 | Cheung | |
| 5,810,499 A | | 9/1998 | Law | |
| 5,836,709 A | | 11/1998 | Cheung | |
| 5,868,513 A | | 2/1999 | Law | |
| 6,036,394 A | * | 3/2000 | Cheng | 402/26 |

* cited by examiner

*Primary Examiner*—Derris H. Banks
*Assistant Examiner*—Mark Henderson
(74) *Attorney, Agent, or Firm*—Shoemaker and Mattare

(57) ABSTRACT

A safety ring binder mechanism helps prevent finger pinching by requiring simultaneous opposite movement of sliding actuators at both ends of the mechanism in order to open and close the rings. When the actuators are outermost, dimples on the actuators press the blades of the device against the housing, holding the rings open. When the actuators are pushed in, inclined tongues cam the ends of the blades downward, forcing the rings to close and holding them in a closed position.

3 Claims, 3 Drawing Sheets

SAFETY RING BINDER HAVING SLIDING ACTUATORS

BACKGROUND OF THE INVENTION

This invention relates to a ring binder mechanism for securing loose-leaf papers.

A typical ring binder mechanism has a sheet metal housing which is longitudinally stiff, but laterally flexible, and contains a pair of blades which are hinged along mating edges. Each blade supports a number of ring halves. The blades have a combined width slightly greater than the width of the housing, so that they toggle between two extreme positions, in one of which the tips of the ring halves meet, forming closed rings, and in another of which the ring halves are open, allowing one to insert or remove loose-leaf papers.

As ring binder users know, the rings can pinch a finger painfully when they snap shut. Prior constructions do not keep one from accidentally getting a finger between the ring ends when closing the ring binder mechanism.

SUMMARY OF THE INVENTION

An object of the invention is to prevent people from pinching their fingers between the rings when closing a ring binder mechanism. A related goal is to provide a construction which requires one to use two hands, away from the ring ends, both to close and to open the rings.

Another object of the invention is to prevent people from opening or closing the ring binder mechanism by manipulating the rings directly, that is, to force the user to use two sliding actuators at the ends of the ring binder mechanism to close and open the rings.

These and other objects are attained by a safety ring binder mechanism having sliding actuators, as described below.

BRIEF DESCRIPTION OF THE DRAWINGS

In the accompanying drawings.

DESCRIPTION OF THE PREFERRED EMBODIMENT

Figure 1:
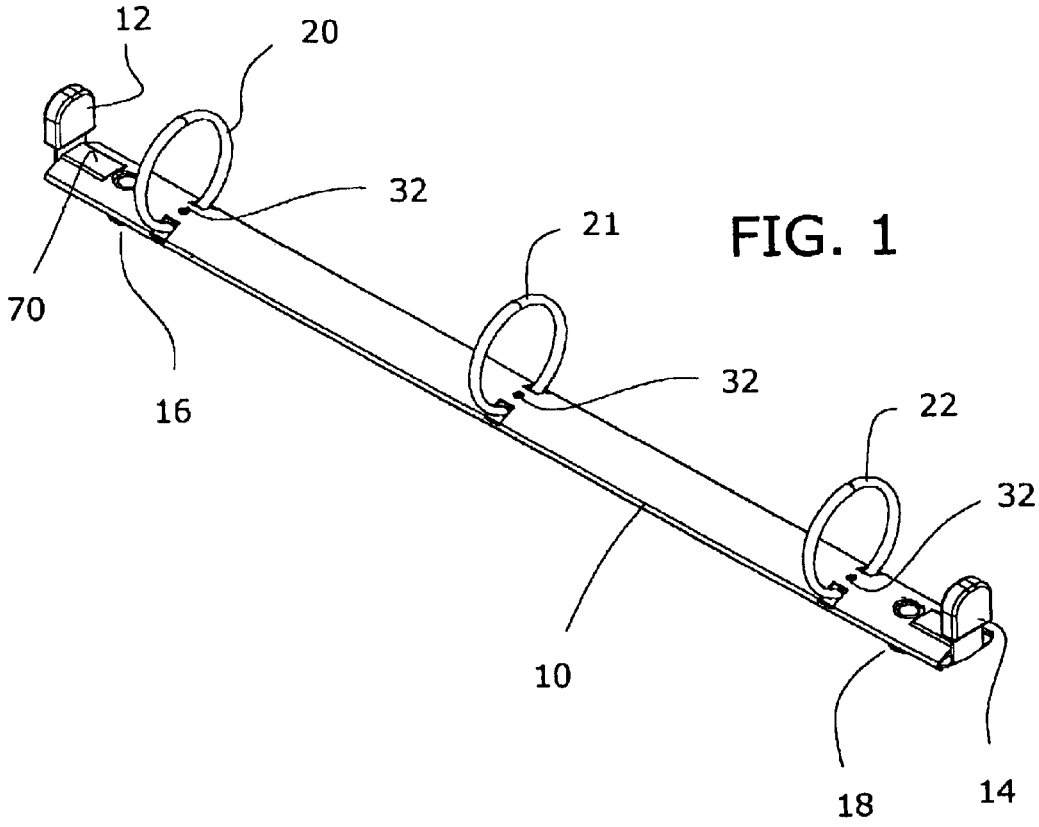
FIG. 1 is an isometric view, from above of a safety ring binder mechanism having two sliding actuators.
Figure 2:
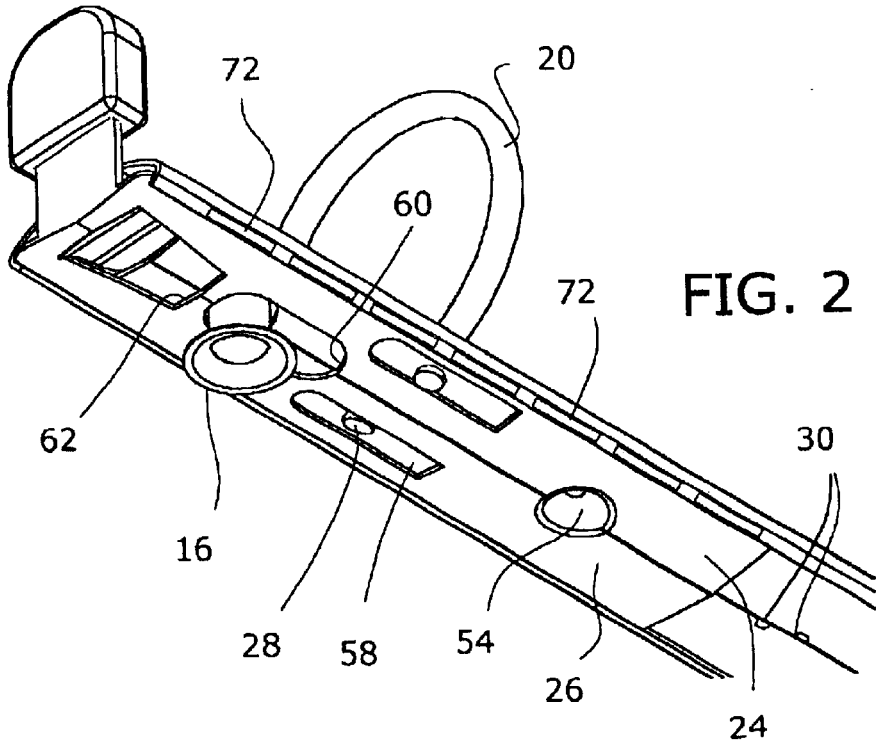
FIG. 2 is an isometric view of the binder mechanism from below.

A ring binder mechanism embodying the invention, illustrated in FIGS. 1 and 2, includes a metal housing 10 which supports opposed sliding actuators 12, 14 at either end. Rivets 16, 18, whose upper ends are secured in holes in the housing, extend downward, for connecting the housing to the spine of a loose leaf ring binder. The rings 20, 21, 22 each comprises two half-rings which are secured to the respective blades 24, 26, by crimping, swaging or staking the lower ends 28 of the rings, where they protrude through holes in the blades.

Figure 4:
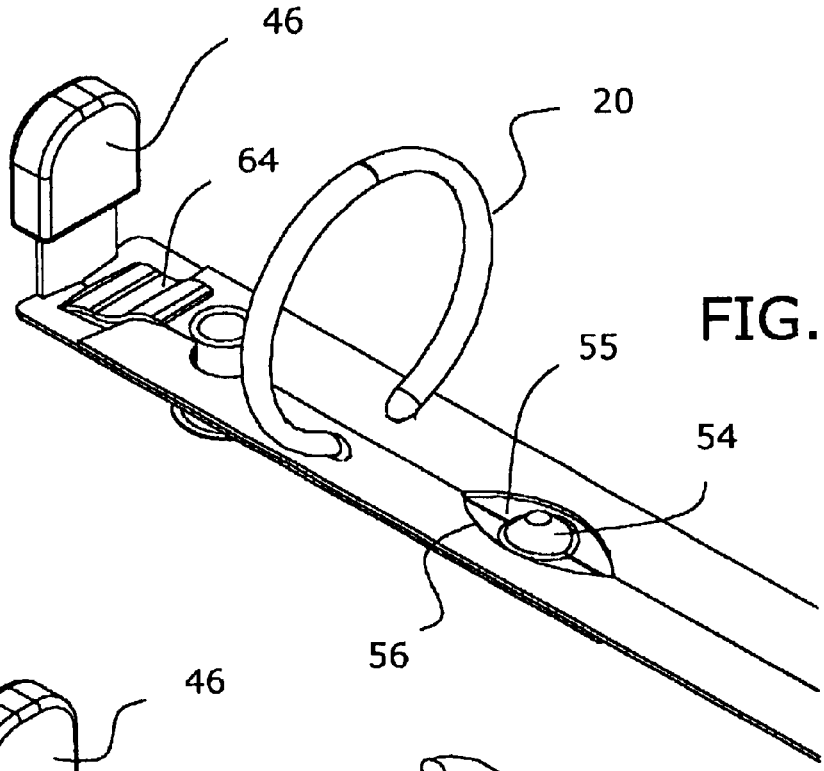
FIG. 4 is an isometric view of the binder mechanism, with the housing removed to show the underlying detail, in the rings-closed configuration.

In FIG. 2, one can see the two blades 24, 26, their inner edges abutting, and being retained in alignment by alternating tab-like deformations 30 formed along the inner edges. In FIGS. 1, 2 and 4, the rings are closed, the inner edges of the blades being below an imaginary plane containing the outer edges of the blades. When the rings are opened (FIGS. 5 and 6), the inner edges move above that plane. The extreme of upward movement is determined by small dimples 32 (FIG. 1) on the top of the housing, against which the inner edges of the blades come to rest.

The rings are open and closed by moving the sliding actuators 12, 14 at both ends of the ring binder mechanism simultaneously, in opposite directions. To open the ring binder mechanism, the sliding actuators are pulled away from one another; to close it, they are pushed toward one another. It does not work, as will be described below, to move just one sliding actuator at a time, so both hands must be involved at once, which keeps them away from the ring tips.

Figure 6:
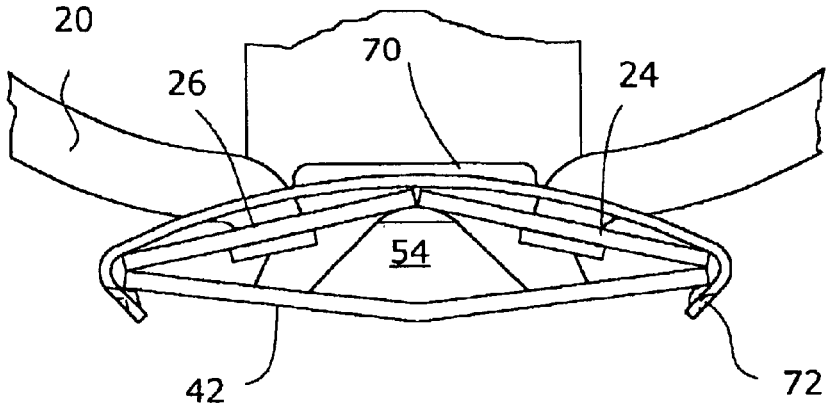
FIG. 6 is a sectional view, on a transverse plane, showing the interaction between the sliding actuators and the blades when the rings are open.
Figure 5:
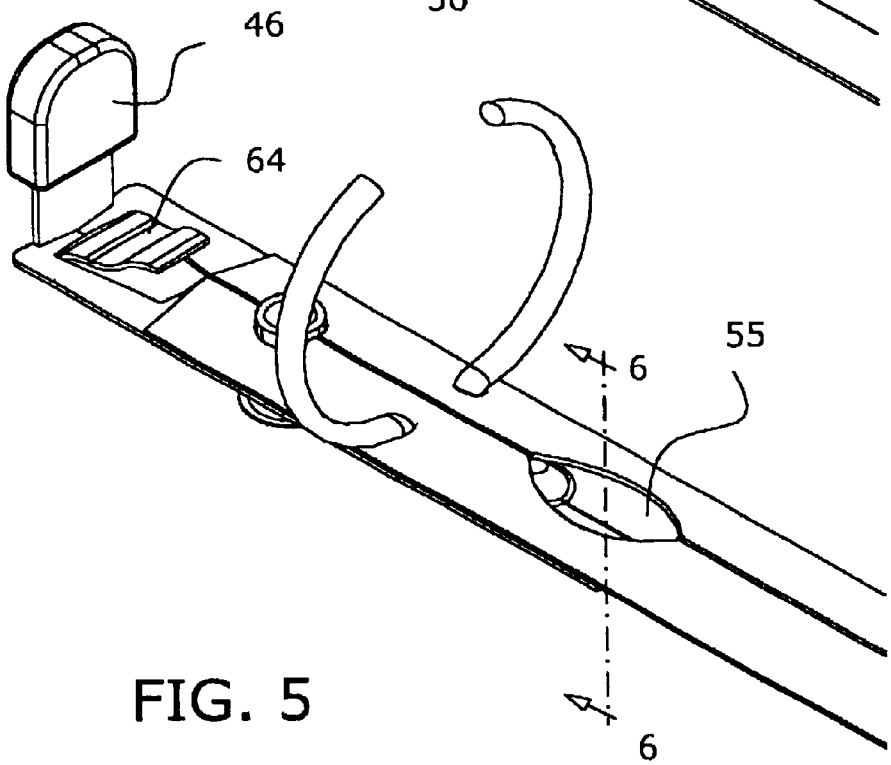
FIG. 5 is an isometric view of the binder mechanism, with the housing removed to show the underlying detail, in the rings-open configuration.

Each sliding actuator 12, 14 includes a generally L-shaped member (FIG. 3) having a long horizontal leg 42 and a short vertical leg 44. A plastic handle 46 is molded around the vertical leg. The horizontal leg has a slight positive dihedral angle defining two wings 48,50; this construction contributes to the bending stiffness of the leg. Near the free end 52, there is a large dimple 54 projecting upward from the leg. The dimple 54 presses upward on the bottoms of the blades 24, 26 when the sliding actuator is pulled out, as illustrated in FIGS. 5 and 6. When the sliding actuator is pushed in (FIG. 4), the dimple rests, disengaged, in an almond-shaped opening 55 formed by opposed cutouts 56 on the inner edges of the blades.

The wings of the sliding actuator are at times flush against the blades; the narrow slots 58 in the sliding actuator are provided to clear the lower ends 28 of the rings. A rivet 16 or 18 passes through the larger slot 60.

Figure 3:
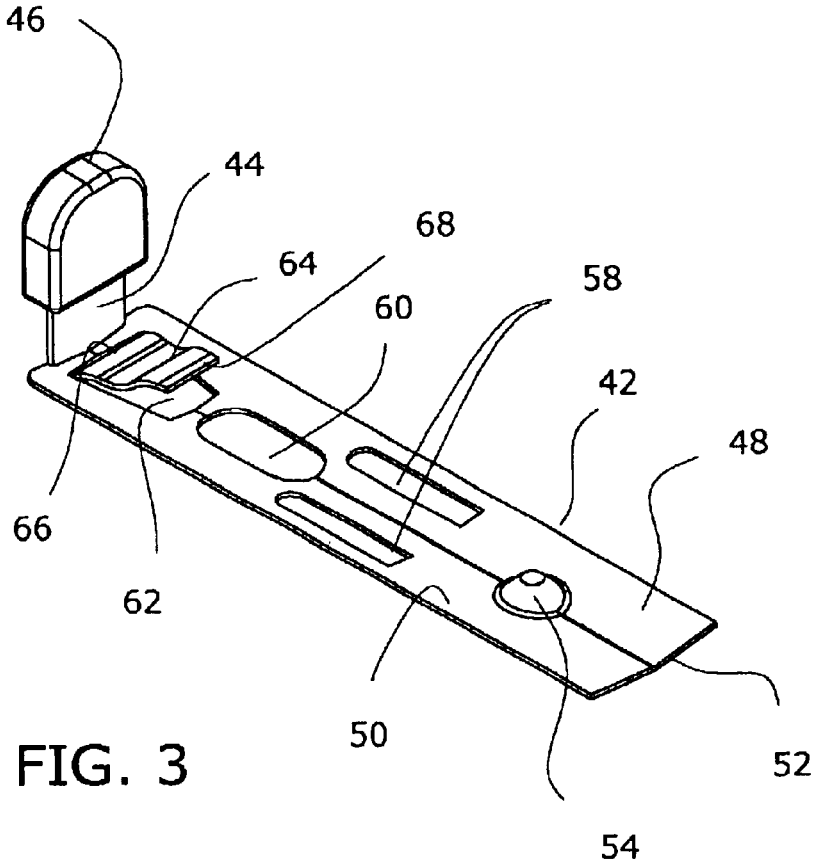
FIG. 3 is a detailed view of one of the sliding actuators.

The pentagonal aperture 62, seen in FIGS. 2 and 3, is created when a tongue 64 is punched upward from the lower leg. The tongue extends, stepwise, obliquely upward from the end 66 which remains connected to the lower leg. The top of the tip 68 of the tongue has about the same elevation as the inside surface of the housing, and is received within a slightly raised region 70 at the end of the housing.

The lower leg of each actuator is retained within the housing, below the blades, when the device is assembled. The housing is deformed by indentations 72 (FIGS. 2 and 6) which extend lengthwise along each side of the housing in the region of the sliding actuators. The indentations increase the interior height of the housing at its edges sufficiently to accept both the sliding actuator and the blades, so that the sliding actuator can freely reciprocate within the housing. The stroke of the sliding actuator is determined by the length of the slot 60 and the outer diameter of the rivets. When the sliding actuator is in its outermost position, as mentioned above, the dimple 54 presses the blades upward against the housing (FIGS. 5 and 6), locking the rings open, and prevents them from being closed manually. When the sliding actuators are pushed in, the dimples disengage the blades as they become aligned with the opening 55, allowing the rings to close (FIG. 4). Simultaneously, the tongues 64 engage the blades 24, 26 from above, forcing them to the rings-closed position. The tongues thus function as sliding cams which bear against the inner end corners of the blades and push them downward during closing.

It may be appreciated that the rings cannot be closed when either dimple 54 is not within the corresponding opening 55, so it is not sufficient to push in just one sliding actuator to close the ring binder mechanism. Both must be moved.

Similarly, because the tongues indirectly hold the rings closed when the sliding actuators are in (by pressing down on the ends of the blades), it does not do to pull out just one sliding actuator when trying to open the ring binder mechanism: both must be pulled. Therefore, one cannot easily get a finger in a position when it might be pinched, when opening or closing the ring binder mechanism.

Since the invention is subject to modifications and variations, it is intended that the foregoing description and the accompanying drawings shall be interpreted as only illustrative of the invention defined by the following claims.

I claim:

1. In a ring binder mechanism having a flexible housing, a pair of blades held in edgewise compression by and within said housing so as to toggle between upward and downward extreme positions, and plural pairs of ring halves, each affixed to a respective one of the blades opposite to a corresponding ring half so that when the blades are at the downward extreme position, the tips of the rings meet, and when the blades are at their upward extreme position, the tips are apart, the improvement comprising:

two pairs of opposed cutouts on said blades, defining two openings, one at either end of the ring binder mechanism, two sliding actuators, each having a longer leg and a shorter leg substantially perpendicular to said longer leg, said longer leg being confined within the housing below the blades, for sliding movement lengthwise of the housing between innermost and outermost positions, each said sliding actuator having a dimple protruding upward from its longer leg a distance such that said dimple forces the blades into their upward extreme position when said dimple is not aligned with said opening, said dimples and openings being disposed so that each dimple is aligned with its respective opening when said sliding actuators are in their innermost positions, but not when said sliding actuators are in their outermost positions;

wherein one of said actuators alone cannot toggle the blades into the downward extreme position.

2. The invention of claim 1, wherein each said sliding actuator has a cam the ends of the blades from above and presses them downward to their downward extreme position when the sliding actuators are moved to their innermost positions.

3. The invention of claim 1, wherein the housing has indentations in is lateral edges, extending lengthwise of the housing from each end thereof to increase an interior height the housing at its lateral edges sufficiently to receive both the sliding actuator and the blades, while permitting the sliding actuator to reciprocate within the housing.

* * * * *